US006897391B2

(12) United States Patent
Gavalda

(10) Patent No.: US 6,897,391 B2
(45) Date of Patent: May 24, 2005

(54) ELECTRIC MEMBRANE SWITCH WITH SEVEN CONTACT POSITIONS

(75) Inventor: Eduard Torrents Gavalda, Tarragon Valls (ES)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/707,924

(22) Filed: Jan. 26, 2004

(65) Prior Publication Data

US 2004/0173448 A1 Sep. 9, 2004

(51) Int. Cl.[7] ..... H01H 1/10

(52) U.S. Cl. ..... 200/512; 200/5 R; 200/6 A; 200/17 R

(58) Field of Search ..... 200/512, 4, 5 R, 200/5 A, 6 R, 6 A, 17 R, 18, 329

(56) References Cited

U.S. PATENT DOCUMENTS 5,813,519 A * 9/1998 Gotoh ..... 200/313
5,952,628 A * 9/1999 Sato et al. ..... 200/4
6,222,525 B1 4/2001 Armstrong
6,359,243 B1 * 3/2002 Nakade et al. ..... 200/6 A
6,441,753 B1 * 8/2002 Montgomery ..... 341/34
6,635,832 B1 * 10/2003 Oster et al. ..... 200/6 A
6,670,562 B2 * 12/2003 Kaneko ..... 200/1 B
6,713,692 B2 * 3/2004 Yamasaki ..... 200/6 A
6,809,274 B2 * 10/2004 Takeuchi et al. ..... 200/6 A

* cited by examiner

*Primary Examiner*—Richard K. Lee
(74) *Attorney, Agent, or Firm*—Bill C Panagos

(57) ABSTRACT

An electric switch of mechanical structure and functioning, and with electric contacts by means of membranes, suitable for optionally arranging seven different control signals by means of other such contact positions selectively induced by a single button means, four of these positions are differentiated when a slight rolling movement is carried out on said button means in any of four opposite directions and 90° equidistant from each other, a fifth contact position in its clockwise axial rotation, the sixth position by means of its counter-clockwise rotation, and a last contact position by means of a linear pulsating movement.

9 Claims, 1 Drawing Sheet

ELECTRIC MEMBRANE SWITCH WITH SEVEN CONTACT POSITIONS

BACKGROUND OF INVENTION

An electric switch of mechanical structure and functioning and of electric contacts by means of membranes, suitable for optionally establishing different control signals by means of other such contact positions selectively induced on a single button means, four of these being differentiated positions when carrying out a slight rolling motion on said button means in any of four opposite directions and 90° equidistant from each other, a fifth contact position in its clockwise axial rotation, the sixth one by means of its counter-clockwise rotation, and a last contact position by means of a linear pulsating movement.

DESCRIPTION OF THE STATE OF THE ART

The use of different compact, electric or electromechanical switch devices is widely known, capable of establishing on demand different signals with which to control different operations in distant, independent mechanisms or apparatuses.

For example, and from among a wide variety of them, electric control devices for positioning the glass plates of the outside rear-view mirrors on automobiles could be mentioned, which, by means of a single handling means, provide the optional rolling of said glass plate, pivoting from its central point in four directions, up, down, to the right and to the left, by which the user can choose and determine a suitable visual field according to his/her requirements. And there are even devices of this nature housing a fifth control, used for carrying out the folding and withdrawal of the mirror assembly, preventing it from projecting when its use is not needed, such as when the automobile is parked.

Another example of this type of devices could be the control lever used in computer game consoles, popularly known as "joystick", which, by means of its rolling and with the aid of one or more buttons strategically arranged on said lever, within reach of the user's hand, permits controlling the different actions with which to participate in the development of said games.

Many other embodiment examples could be mentioned in which multiple switch devices such as those mentioned are used, but in the majority of the cases, they have certain limitations, either related to the fragility of the constitution thereof or to the restriction in the performances thereof.

DESCRIPTION

It is on the basis of the aforementioned, among other reasons and objects, that the invention concerning us has been proposed. In effect, the goal is to provide an electromechanical switch with a simple and efficient design, suitable for permitting the arrangement of seven different contact positions from a single common control shaft or member. Said switch is constituted by a series of heavy-duty mechanical elements cooperating together to carry out a selective and direct delivery of seven different signals coming from a single control member to a control signal generator means, capable of recognizing the nature of said signals and of emitting a corresponding and differentiated control signal for any purpose.

An object of the invention consists of providing said switch, in which the electronic parts are reduced just to the inclusion of contact means included in a membrane associated to a simple, integrated circuit board, the remaining parts being mechanical, providing it with a strong and resistant structure, and therefore long-lasting.

Another object of the invention is providing for said switch said electric contact means located in the cones fixed solidly to the membrane, and which have a contact wafer inside and in the lower part formed from a material with high conductivity, such as carbon, gold, etc., which facilitates a suitably reliable connection.

A further purpose of the invention consists of providing said switch, in which the return operations to the initial positions of its movable parts are carried out by means of inducing its membrane's elastic memory, preventing the inclusion of accessory parts for this purpose except, as will be seen below, for the linear pulsating shift, for which return action a spring has been used.

BRIEF DESCRIPTION OF DRAWINGS

In order to facilitate understanding the electric membrane switch with seven contact positions, a figure is attached to the present patent application whose purpose is to better understand the principles on which the invention concerning us is based and to better understand the description of a preferred embodiment, keeping in mind that the character of the figure is illustrative and non-limiting.

DETAILED DESCRIPTION

Figure 1:
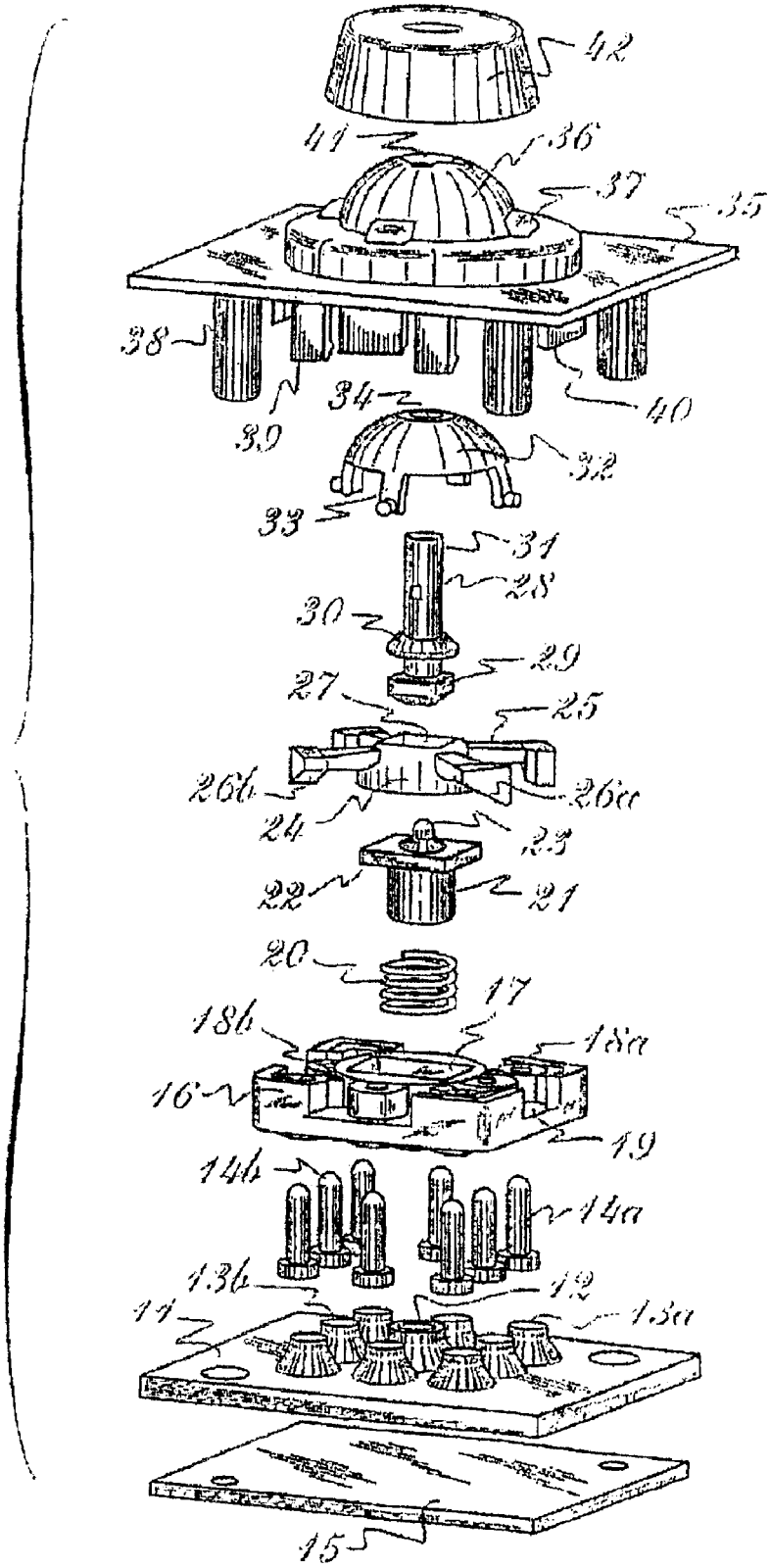
FIG. 1 shows a sequential exploded perspective view of the elements intervening in and constituting the switch of the invention, and in which its configuration as well as the arrangement of the parts thereof can be seen clearly.

The qualities and advantages of the invention will become evident for all those skilled persons in the art throughout the development of the following detailed description, which is carried out in relation to the attached figure, and which shows a currently preferred embodiment, from among other possible embodiments, of the switch concerning us, constituted from the descriptions of the present embodiment, which are provided with a purely illustrative and in no case limiting character.

With regard to the drawing, 11 designates a rectangular-shaped laminar membrane which has a central cone 12 on its upper surface solidly fixed to it, four cones 13*a* arranged in a diagonal position, each one in the direction of the corresponding corner of the membrane 11, and four other intermediate cones 13*b* in line with each two of the previous cones 13*a*; and all of them having a contact wafer inside, not shown in the drawing, suitable for selectively establishing contact with the circuits housed on a printed circuit board 15 adjacently arranged on the lower surface of said membrane 11 and having its same extension.

In correspondence with each peripheral cone of the membrane, an actuator in pin form is seated which has a lower support base and has its upper end rounded, the four corner-arranged cones 14*a* provided for receiving the rotation movement impulse and the four intermediate cones 14*b* provided for receiving the rolling movement, as will be defined below.

The disclosed assembly is held in place by means of a base plate 16 provided with vertical cylindrical passages 18*a* and 18*b* corresponding to the arrangement of the cones 13*a* and 13*b*, as well as to the actuators 14*a* and 14*b*, respectively, permitting vertical shifting of the latter. A central passage 17 is arranged in the center of said base plate 16, which has a cylindrical section on its lower end, not shown, with a dimension similar to the diameter of the opening of the central cone 12 of membrane 11 on which it is seated, and an upper, square section for the purpose indicated below. Complementarily, on each longitudinal side, said base plate 16 has recesses 19 whose purpose will also be defined below.

A cylindrical piston 21, which has a transversal peripheral projection or square flange 22 on its upper part, as well as a lug 23 in upper axial projection, is housed on the square passage 15 of the base plate 16 by means of an enveloping spring 20, such that its lower end is in contact with the upper surface of the central cone 12 of membrane 11. Furthermore, this piston 21 can be provided with a central cavity where a LEC (light-emitting electrochemical cell) diode can be arranged for illumination.

A crosspiece 24 has four transversal arms 25 arranged at 90° from each other, whose ends have a linear cam surface 26*a* and 26*b*, on inclined plane and in a lower position, whose said inclined or cam plane is inverted with regard to the adjacent arm's cam plane, for a purpose which will be described below; and the center of said crosspiece 24 has a passage 27 with a square, truncated pyramid section suitable for being housed on the flange 22 of the piston 21, and for housing a rod 28 in its upper part.

The lower part of said cylindrical-shaped rod 28 is finished by means of a quadrangular enlargement 29 with a central cavity, not shown, by means of which it is supported and pivots on the lug 23 of the piston 21, and it is provided with a perimetral flap 30 and with a transversal groove 31 on its upper end.

A laminar element in cap 32 form, having four downward pins 33 spaced 90° from each other, and having a passage 34 on its shaft by which it is introduced on the rod 28 until being seated on its flap 30, such that said pins 33 will be supported on the intermediate actuators 14*b*.

And a laminar body 35 element with an area similar to the areas of the membrane 11 and the printed circuit board 15 is provided with a dome-shaped bulking 36 with inner grooves 37 spaced 90° from each other, forming a lower cavity for being loosely housed on the cap 32 element, such that when the pins 33 of the cap are fitted inside of said grooves 37, they prevent its rotation, but said looseness permits the rolling of said cap 32, in the manner of a ball joint. A cross-shaped through cavity 41 is made on the zenith of dome 36, being suitable for housing it on the rod 28, and for permitting it to project and roll in the directions defined by the arms of the cross-shaped cavity 41.

Four solidly fixed cylindrical columns 38 project vertically downwards from the lower surface of said body 35 element close to its corners, having a length that will define and fix the position of the integrant assembly elements when fixed by means of screws or the like to the membrane 11 and to its associated circuit board 15. In at least two of its opposite sides and close to its edge, two laminar bands 39 project downwards, being provided with a small triangular projection on their lower part and adjacent to their lower edge, suitable for being embedded in bayonet form on the lower edge of the base plate 16 and for holding the position of the element assembly arranged between the latter and the body 34. A small guide partition 40 centered on one of the side edges of the base element 35 projects downwards with a smaller length than the closure bands 39, being suitable for being coupled on the side recesses 19 of the base plate 16.

Lastly, a conventional control 42, which can be cylindrical or truncated pyramid, is tightly adjusted on the upper grooved 31 end of rod 28.

In this arrangement, membrane 11 is in contact by its lower part with the printed circuit board 15, whose cones 13*a* and 13*b* support the actuators 14*a* and 14*b*; the base plate 16, housed on said actuators, is supported on the opening of said cones, such that the ends of the actuators project above its upper surface; the piston 21 and its associated spring 20 are fitted over passage 17 of base plate 16; crosspiece 24 housed on flange 22 of piston 21 permits the cam 26*a* and 26*b* surfaces of its arms to be supported on the corner actuators 14*a*; the rod 28 is pivotally supported on the lug 23 of the piston 21; the cap 32, housed on the rod 28, is seated on its peripheral flap 30 and with its pins 33 supported on the ends of the intermediate actuators 14*b*; and the body element 35 is covering the assembly and fixing its position by means of its fixing by bayonet embedding to the base plate 16 and by means of screws or any other similar means, by means of its columns 38, to the assembly formed by printed circuit board 15 and membrane 11, the upper grooved 31 end of the rod 28 projecting from the upper part of the dome 36 of the body element 34, upon which the control 40 is fitted.

Then, when a clockwise or counter-clockwise signal is given to said control 42, the latter transmits it to crosspiece 24 through rod 28, such that every two opposite arms 25, since the inclined plane cam surfaces are inverted, will press or will be distanced, respectively and according to the rotation direction, making the actuators 14*a* on which they are supported shift vertically, either those in two opposite corners or those of the other two corners, those which in turn press on the cones 13*a* of the membrane 11, making them enter into electric fluid contact with the printed circuit board, which will emit a certain control signal. When the rotation impulse pressure stops, the cones of the membrane 11 will induce the crosspiece 24 to recover its initial position.

When the control 42 is induced into a rolling lateral shift in any of the four directions defined by the cross-shaped passage 41 of the dome 36 of the body 35 and fixed by the guide of the pins 33 of the cap 32 through the grooves 37 of said body 35, this movement is transmitted to the rod 28 which, pivoting on the lug 23 of the piston 21, makes the cap 32 shift like a ball joint, such that one of its pins 33 presses on the upper end of the corresponding intermediate actuator 14*b*, which acts as in the case of the rotational movement, in other words, pressing on the corresponding cone 13*b* of membrane 11 in order to make it enter into electric fluid contact with the printed circuit board, which will emit a differentiated control signal. And likewise, when the actuation on the control 42 stops, the cone will push the actuator, which in turn will press on the pin of the cap and will make it recover its initial position. And when linear pressure is carried out on said control 42, the control transmits it to piston 21 through rod 28 which, counteracting the expansive action of spring 20, acts directly by pressing on central cone 12 of membrane 11, the same process being carried out as in the previous cases for the emission of a differentiated control signal, and, when said pressure stops, the elastic memory of spring 20 will make piston 21 recover its initial position and, consequently, the element assembly associated to it.

The invention, within its essence, can in practice be carried out in other embodiment forms only differing in details from the embodiment indicated as an example. It can be carried out in any shape and size, with the most suitable means and materials and with the most suitable accessories, the component elements can be replaced by other technically equivalent ones, for this all to remain comprised within the claims.

What is claimed is:

1. An electric membrane switch, suitable for selectively delivering seven control signals with which to control other such differentiated operations, of the type comprising a membrane (11) on one or more areas on which one or more pushers act and which has associated contacts susceptible to closing an electric circuit when said membrane (11) is shifted, generating an electric signal, and to opening said circuit when it elastically returns to a standstill position, characterized by comprising a laminar membrane (11) element on one side of which nine support means (12, 13*a*, 13*b*) of eight actuator means (14*a*, 14*b*) and a piston (21) element are arranged, the latter in central position (12) and the remaining ones (13*a*, 13*b*) distributed around it, each one associated to a corresponding contact, said actuator means (14*a*, 14*b*) being constituted by several pins (14*a*, 14*b*) susceptible to being actuated individually in pushing against said membrane (11) as from a piston (21) element, the central pin as from a cap (32) with four pins (33), said pins being supported on the rounded ends of four of said pins (14*b*), the four remaining pins (14*a*) being actuated in pairs by the arms (25) of a crosspiece (24) finished in slanted ramps (26*a*, 26*b*), the cap (32) and crosspiece (24) being actuated from a single rod (28) element passing through them and coupled to them, said rod (28) element being finished by an actuation member (42).

2. An electric membrane switch according to claim 1, characterized in that the laminar membrane (11) element is provided with support means (12, 13*a*, 13*b*) for supporting actuator means (21, 14*a*, 14*b*) of the device and means for receiving its selective impulse and transmitting it to a printed circuit board (15) associated to them, for the purpose of closing a circuit and favoring the elaboration of an electric control signal, inducing said actuator means (21, 14*a*, 14*b*) to their initial inoperative position when said impulse stops by means of their elastic memory, inoperative when said impulse stops; said support means (12, 13*a*, 13*b*), nine of them, being truncated-pyramid bases elevated from one of the surfaces of the laminar membrane (11), said support means (12, 13*a*, 13*b*) housing outside electric contact means on their opposite surface and adjacent to said printed circuit board (15); of said support means (12, 13*a*, 13*b*), one being arranged in the center (12) and the remaining ones aligned in three's (13*a*, 13*b*), the four support means (13*a*) located in the corners being arranged equidistant with regard to the central one, and the intermediate support means (13*b*) being arranged in a different equidistance.

3. An electric membrane switch according to claim 1, characterized in that the eight actuator means (14*a*, 14*b*) in cylindrical pin (14*a*, 14*b*) form have a support base suitable for being supported respectively on each one of the peripheral support means (13*a*, 13*b*) and their end opposite to the support is rounded, said cylindrical pins (14*a*, 14*b*) being suitable for receiving an impulse on their rounded end and linearly transmitting it to the support means (13*a*, 13*b*), said support means (13*a*, 13*b*) being supported on a base plate (16) having passages (18*a*, 18*b*) suitable for housing the actuator means (14*a*, 14*b*), these actuator means (14*a*, 14*b*) projecting through the upper plane of the base plate (16) and permitting a linear shift thereof (14*a*, 14*b*), said base plate (16) provided with a central housing (17) suitable for housing a piston (21) element, permitting contact between said piston (21) element and the central support element (12) of the membrane (11) element.

4. An electric membrane switch according to claim 1, characterized in that the cylindrical-shaped piston (21) element has a peripheral flange (22) of a polygonal area on one of its ends and a pivoting support element in the form of a lug (23) axially on said end with regard to the body, said piston (21) element being suitable for being introduced in the central housing (17) of the base plate and establishing contact with the central support means (12) of the membrane (11) element, and optionally induces its electric contact means to enter into electric fluid contact with the printed circuit board (15), closing a circuit on it and making the board (15) emit a control signal; its relative linear position being defined inside of said housing (17) by means of an enveloping spring (20) susceptible to carrying out a linear shift due to a push carried out on its lug (23), counteracting the expansive action of the spring (20), and to recovering its initial position when said pressure stops, due to the action of the memory of the spring (20).

5. An electric membrane switch according to claim 1, characterized in that the crosspiece (24) element in the form of a cylindrical body with a truncated pyramid-shaped central passage (27) with a polygonal section, the lower part corresponding to the perimeter of the flange (22) of the piston (21) element on which the crosspiece (22) sits preventing the rotational shifting between them both, is provided with four transversal arms (25) whose lower free ends, in direction to the piston (21) element, are provided with a linear cam surface (26*a*, 26*b*) on inclined plane transversal to the center and with said inclined plane being opposite with regard to the adjacent arms (25); said crosspiece (24) element being housed on the piston (21) element, the cam planes (26*a*, 26*b*) of the ends of its arms (25) thus being supported on the peripheral actuator (14*a*) corner elements, such that by inducing a rotation movement to said crosspiece (24) element, every two opposite cam (26*a*, 26*b*) surfaces of its arms (25) supported on the actuator (14*a*) elements will press on or will be distanced from them, according to the clockwise or counter-clockwise rotation direction, and pressing, respectively, on two of the corner actuator (14*a*) elements, opposite from each other, in one direction and the other two in the opposite direction, returning to their initial position by means of said cam (26*a*, 26*b*) surfaces when the rotational impulse stops, and being provided with a central passage (27) on its upper part, having a polygonal section suitable for housing the rod (28) element.

6. An electric membrane switch according to claim 1, characterized in that the cylindrical-shaped rod (28) element has a cubic bulking (29) on its lower end, corresponding to and suitable for being loosely housed on the upper part of the central passage (27) of the crosspiece (24) element, permitting its linear and pivotal shift, but preventing its rotational shift, said lower end (29) of the rod (28) axially provided with a cavity suitable for being pivotally seated on the lug (23) of the piston (21) element, the upper end of said rod (28) element being provided with a transversal groove (31) and, perimetrally and close to the cubic bulking (20) of its lower end, a peripheral flap (30) in spherical crown form, suitable for housing the cap (32) element.

7. An electric membrane switch according to claim 1, characterized in that the cap (32) element in laminar spherical cap form, has a central cylindrical passage (34) corresponding to the cylindrical body of the rod (28) element, and four pins (33) in downward projection spaced 90° from each other, suitable for when said cap (32) element is housed on said rod (28) element, until being seated on its flap (30), said pins (33) being seated on the end of the intermediate actuator (14*b*) elements, such that by inducing a pivoting impulse on said rod (28) element, the latter drags the cap (32) element in one of the four directions defined by said pins (33) pressing on the corresponding actuator (14*b*) element and returning to its initial position when said pivoting impulse stops.

8. An electric membrane switch according to claim 1, characterized in that it is provided with a body (35) element in laminar portion form with an area corresponding to the area of the membrane (11) element and the associated printed circuit board (15), provided with separator means (38) and fixing means (39, 40) between the body (35) element and said membrane (11) element in the form of solidly fixed columns (39) projecting downwards, suitable for being fixed to said membrane (11) means and holding the axial-linear position of the intermediate elements, being provided with additional fixing means in the form of laminar bands (39) spaced from each other, downwardly arranged from its lower surface and adjacent to the edge of tow of its opposite sides, said laminar bands (39) having a triangular projection on their inner side end for embedding in bayonet form on the lower edge of the base plate element (16), also having guide means (40) in the form of downward laminar bands (40), centered and adjacent to the edges for being housed on the lateral recesses (19) of said base plate element (16), said body (35) element also being provided with a centered semi-spherical dome (36) on its upper surface for being housed on the cap (32) element and permitting a shift like a ball joint, which has four grooves (37) inside arranged 90° from each other, said grooves corresponding to the pins (33) of the cap (32) element which, when said pins (33) are fitted in said grooves (37), they will limit the rotation between the cap (32) element and the body (35) element, said dome (36) being provided with a central cross-shaped passage (41) on its zenith, suitable for permitting the projection of the grooved (31) end of the rod (28) element and guiding its pivotal shift in four different directions, also being provided with a control (42) element in button form, suitable for being housed on the grooved (31) end of the rod (28) element, and suitable for receiving a linear impulse, respective rotation impulses and four different pivoting impulses from a user with which seven different control signals can be generated.

9. An electric membrane switch according to claim 1, characterized in that the linear pressure exerted on the control (42) element is transmitted to the rod (28) element, which in turn transmits it to the piston (21) element on which it is seated, said piston (21) element counteracting the action of an associated spring (20) pushing the central cone (12) of the membrane (11) element which, when entering into electric fluid contact with the corresponding circuit of the printed circuit board (15), emits a first control signal; the rotational impulse exerted on said control (42) element is transmitted to the rod (28) element, transmitting said impulse in turn to the crosspiece (24) element which, by means of the cam **(26*a*) surfaces of its arms, presses on two opposite actuator (14*a*) elements, according to its rotation, which, upon pressing on the cones (13*a*) on with they are seated, will propitiate the emission of two different control signals, one signal when the rotation is clockwise and another different signal when it is a counter-clockwise movement; and the pivotal shift induced on the control (42) element in any of the four opposite trajectories defined by the cross-shaped passage (41) of the body (35) element causes the jointed shift of the cap (32) element, and in consequence, the corresponding pin (33) presses against the actuator (14*b*)** element on which it is seated, in order to produce a differentiated pulse for each one of said four movements.

* * * * *